US007318756B2

(12) United States Patent
Mahoney et al.

(10) Patent No.: US 7,318,756 B2
(45) Date of Patent: Jan. 15, 2008

(54) INTERNAL CONNECTOR SEIZURE MECHANISM

(75) Inventors: William G. Mahoney, Suwanee, GA (US); Robert R. Riggsby, Atlanta, GA (US)

(73) Assignee: Scientific-Atlanta, Inc., Lawrenceville, GA (US)

( * ) Notice: Subject to any disclaimer, the term of this patent is extended or adjusted under 35 U.S.C. 154(b) by 0 days.

(21) Appl. No.: 11/275,197

(22) Filed: Dec. 19, 2005

(65) Prior Publication Data

US 2006/0281370 A1 Dec. 14, 2006

Related U.S. Application Data

(60) Provisional application No. 60/595,192, filed on Jun. 14, 2005.

(51) Int. Cl.
*H01R 13/24* (2006.01)

(52) U.S. Cl. ..... 439/700; 439/63

(58) Field of Classification Search ..... 439/700, 439/824, 63, 578, 581
See application file for complete search history.

(56) References Cited

U.S. PATENT DOCUMENTS 2,640,118 A * 5/1953 Werner ..... 333/22 R
3,946,390 A * 3/1976 Alexander et al. ..... 343/702
5,440,282 A * 8/1995 Devendorf et al. ..... 333/185
5,731,710 A * 3/1998 Mizuno et al. ..... 324/761
6,152,743 A * 11/2000 Fox ..... 439/63
6,811,447 B2 * 11/2004 Pfister et al. ..... 439/700

* cited by examiner

*Primary Examiner*—James R. Harvey
*Assistant Examiner*—Travis Chambers

(57) ABSTRACT

An internal seizure assembly for providing connectivity with a conductor of a stinger without having access to the seizure assembly itself from the exterior. The seizure assembly includes a seizure lock nut for securing the seizure assembly within an opening within the interior of a housing. A seizure holder for receives a plunger therethrough and the plunger urges the conductor of the stinger into electrical contact with the seizure lock nut. In one embodiment, the plunger has an end keyed to the bottom of the opening in the housing to prevent the plunger from turning.

20 Claims, 5 Drawing Sheets

INTERNAL CONNECTOR SEIZURE MECHANISM

CROSS-REFERENCE TO RELATED APPLICATIONS

This application claims priority to U.S. provisional application Ser. No. 60/595,192 filed Jun. 14, 2005, which is incorporated herein by reference.

TECHNICAL FIELD

The present invention relates to controlled cable management within an enclosure such as a CATV node.

BACKGROUND OF THE INVENTION

The conductors that transport RF signals through a network may typically be connected at various points within the network such as headends, central offices, nodes, distribution equipment and subscriber premises. The connectors are typically designed to minimize signal loss and to have impedance that matches that of the conductors being connected. The network nodes may include devices that are located outdoors and may be aerially hung from a conductor strand or be positioned on a pedestal or in a cabinet on the ground. In either case, a technician typically installs a stinger which is a known device for providing an RF connection through a penetration into a housing such as a node housing. The stinger includes a center conductor that axially projects from the stinger.

The stinger captures and transfers electrical signals to the shield and conductor of a co-axial cable commonly referred to as a co-axial hard line cable. Most transmission products require housings to be open and an amplifier and or amplifier module be removed in order to physically access the axial hard line seizure. The stinger is threaded into a bushing which is itself threaded into the node housing penetration. When the stinger is in the installed position, the center conductor projected into the node housing is guided into the interior of the housing through a narrow channel so that a threaded seizure mechanism may contact the center conductor of the stinger when the seizure mechanism is screwed into place with the axis of the seizure mechanism being perpendicular to the stinger.

Scientific-Atlanta's U.S. Pat. No. 6,811,447, which is incorporated herein by reference, depicts how physical access from the exterior of the rode housing is required for exerting a force on the center conductor of a stinger so that the center conductor will then contact the nail head of the seizure mechanism. Known seizure mechanisms have a torque specification and are susceptible to changes in temperature and environmental conditions. If the seizure mechanism is not tightened correctly, there can be electrical performance degradation and a potential heat problem if the connection resistance is poor and power is being passed.

What is needed is a new internal seizure assembly which would eliminate weather leak points and which would no longer require access from the exterior in the event it would become obstructed by a mounting surface such as a wall or pedestal due to the manner in which the node housing was mounted. Moreover, the amplifier or amplifier module should not have to be removed from the interior of the node housing in order to access the seizure assembly.

DETAILED DESCRIPTION

The present invention will be described more fully hereinafter with reference to the accompanying drawings in which like numerals represent like elements throughout the several figures, and in which an exemplary embodiment of the invention is shown. This invention may, however, be embodied in many different forms and should not be construed as being limited to the embodiments set forth herein; rather, the embodiments are provided so that this disclosure will be thorough and complete, and will fully convey the scope of the invention to those skilled in the art. The present invention is described more fully hereinbelow.

Figure 1:
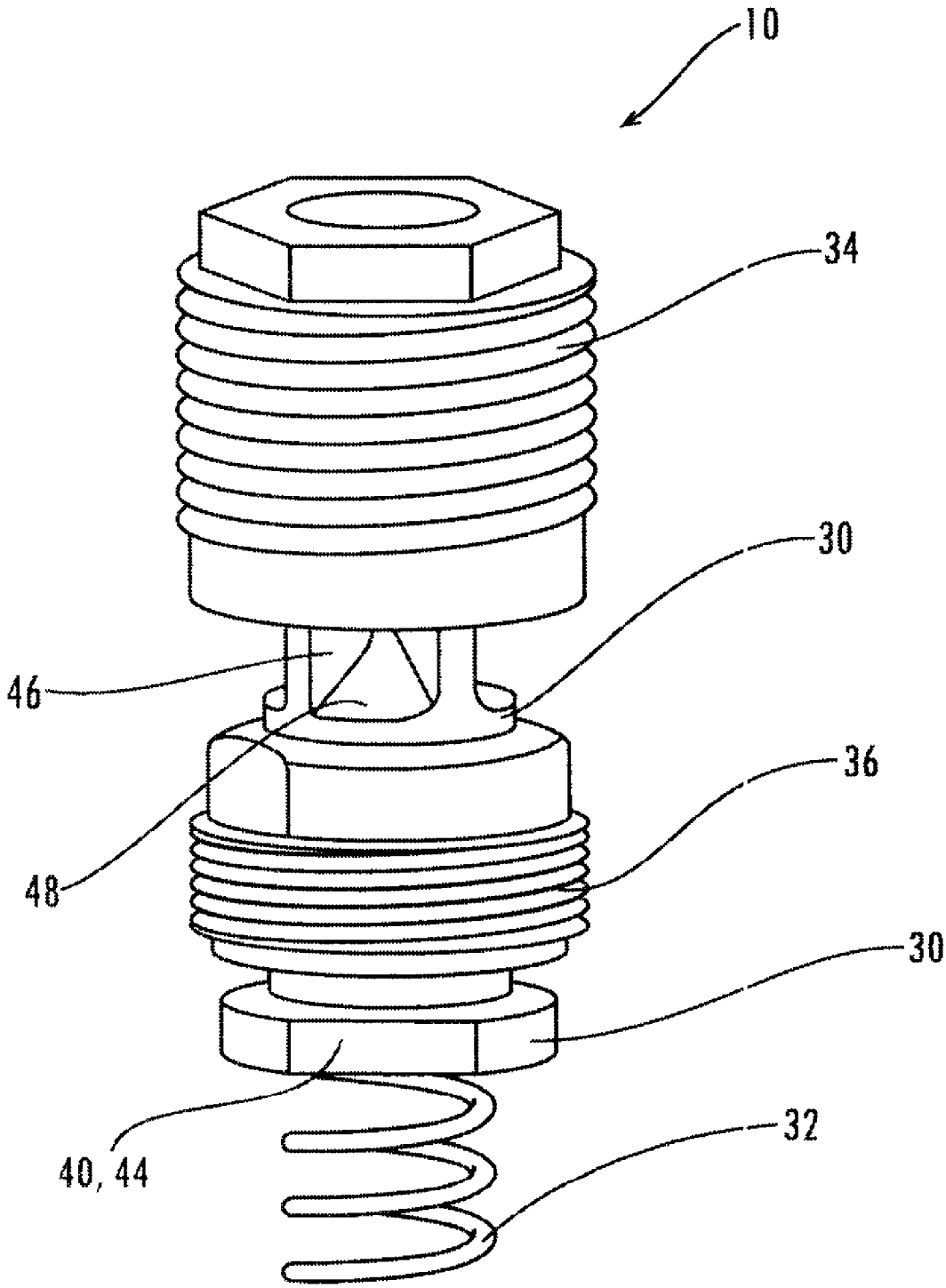
FIG. 1 illustrates a perspective view of an internal seizure assembly according to one embodiment of the present invention.
Figure 2:
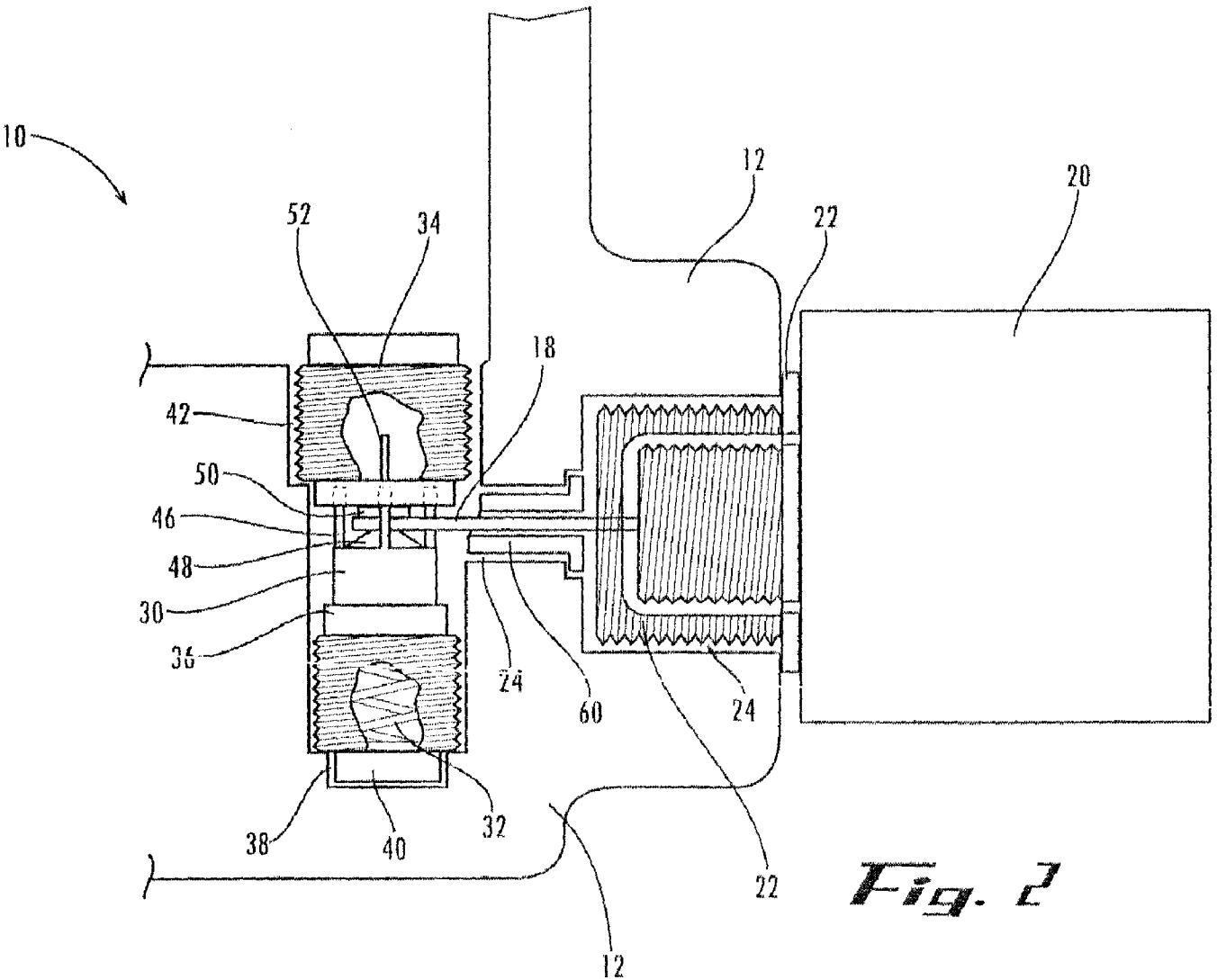
FIG. 2 illustrates a partial cross sectional view of the seizure assembly in a node housing.

The present invention includes a seizure assembly 10 as depicted in FIG. 1 according to one embodiment of the present invention. FIG. 2 depicts the seizure assembly 10 mounted in a housing 12 such as a node housing for providing connectivity to the external co-axial hard line cable via center conductor 18 of stinger 20. The stinger 20 is screwed into a bushing 22 which is itself threaded into a penetration 24 in the lousing 12.

Figure 3A:
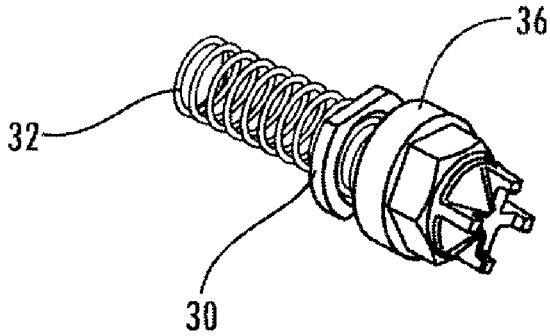
FIG. 3A illustrates a perspective view of a plunger, spring and seizure holder of the connector seizure assembly of the present invention.
Figure 3B:
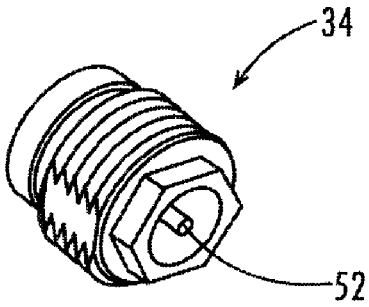
FIG. 3B illustrates a perspective view of a seizure lock nut of the connector seizure assembly according to one embodiment of the present invention.
Figure 3C:
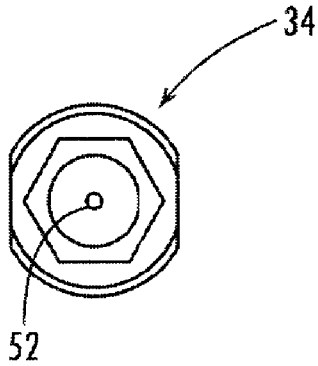
FIG. 3C illustrates an end view of the seizure lock nut of FIG. 3B.
Figure 4:
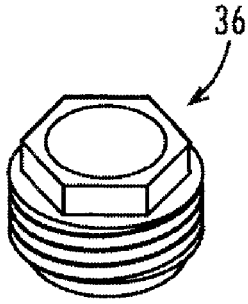
FIG. 4 illustrates a perspective view of a seizure holder of the seizure assembly according to one embodiment of the present invention.
Figure 5A:
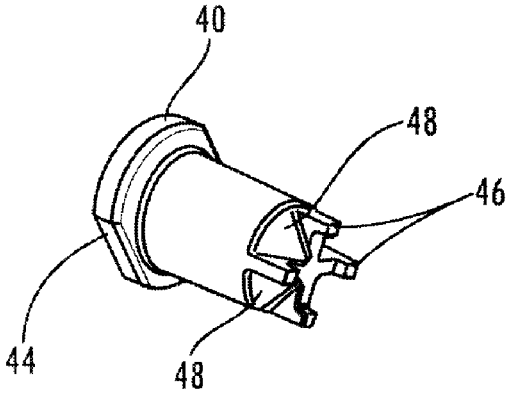
FIG. 5A illustrates a perspective view of a plunger of the seizure assembly according to one embodiment of the present invention.
Figure 5B:
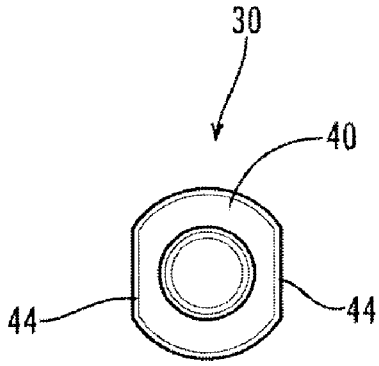
FIG. 5B illustrates an end view of the plunger of FIG. 5A.
Figure 5C:
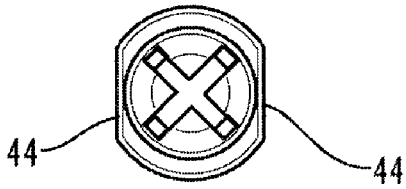
FIG. 5C illustrates another end view of the plunger of FIG. 5A.
Figure 5D:
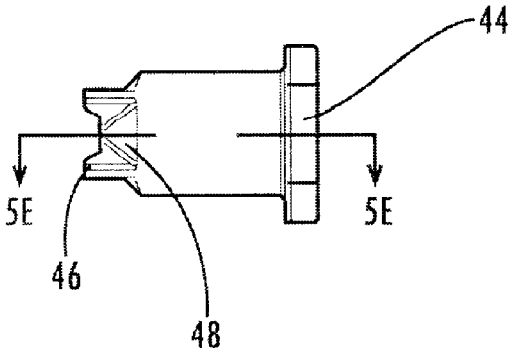
FIG. 5D illustrates a side view of the plunger of FIG. 5A.
Figure 5E:
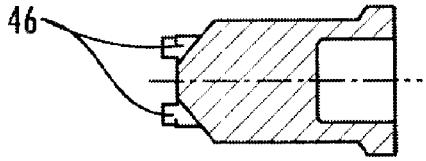
FIG. 5E illustrates a cross-section view taken along line 5E-5E of FIG. 5D.

The seizure assembly 10 includes a plunger 30, spring 32, seizure lock nut 34 and seizure holder 36, which are shown in grater detail in FIGS. 3A-C. The plunger 30 is preferably elongated and includes a first end 40 that is configured to be keyed to be received in an opening 42 cast or formed in the housing 12 beneath the seizure assembly 10. The bottom 38 of the opening 42 is configured to prevent the first end 40 of the plunger 30 from turning. This is preferably done by having the first end 40 be double-D shaped or obround so that it will correspond to a double-D shaped or obround bottom 38, or otherwise similarly shaped, so that the plunger 30 will not rotate within the opening 42. The circumference of the first end 40 maybe chamfered or have one or more straight edges 44. The seizure holder 36, shown in particular in FIG. 4, is threaded into opening 42 and holds down the plunger 30 to retain the spring 32 within the plunger 30 in a partially compressed position.

The second end of the plunger 30 may be referred to as a crown, based upon its preferred shape as shown in FIGS. 5A-E. The second end includes a plurality of vertically oriented legs 46 extending outward from the second end. These legs 46 are preferably positioned equal distant apart along the periphery of the second end of the plunger 30. Also, the second end is preferably configured such that the longest point of the plunger 30 is approximately at the center line of the plunger 30 and also so that the second end of the plunger 30 itself gradually extends upward between adjacent pairs of legs 46. The inclines between adjacent legs 46 may be referred to as ramps 48 because the distal end of the center conductor 18 of the stinger 20 when being installed contacts the second end of the plunger 30, between the legs 46, and is guided up one of the ramps 48 to the apex of the plunger 30. The legs 46 and ramps 48 help to keep the center conductor 18 centered on the top of the plunger 30. Because the plunger 30 is keyed to the bottom 38 of the opening 42 of the housing 12, the legs 46 may be oriented not to obstruct the distal end of the center conductor 18 as it is passed into the interior of the housing 12 through penetration 24. The center conductor 18 then depresses the plunger 30 without significantly bending of the center conductor 18 of the stinger 20, but the center conductor 18 also is forced or urged into contact with the bottom of the seizure lock nut 34 which has a contact point 50, shown in FIG. 2, in electrical contact with a center pin 52. The center pin 52 may connect to a G connector of the amplifier, or any device that uses an RF G connection, in the node housing 12. The distal ends of legs 46 are received in openings which exist in the bottom of the lock nut 34.

As shown in FIG. 2, when the center conductor 18 is being installed in the bushing 22 in penetration 24 of housing 12, the distal end of the center conductor may be passed through a guide 60 positioned and retained within the penetration 24 behind the bushing 22. The guide 60 is preferably made of Methylpentene Copolymer (TPX), Delrin, or some other suitable material, and configured to correspond with the narrow portion of the penetration 24. This narrow portion of the penetration behind the bushing 22 has been enlarged compared to other node housings in order to optimize the impedance. If the guide 60 is not present in the penetration 24, the spacing between the center conductor 18 and the housing 12 needs to be closer, but then the impedance will not be optimized.

Figure 6A:
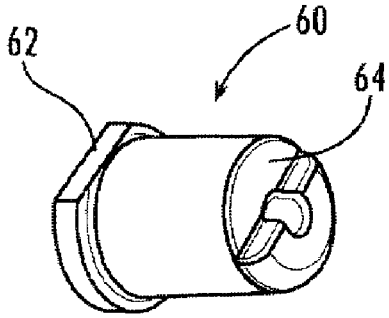
FIG. 6A illustrates a perspective view of one embodiment of a guide for use with the seizure assembly of FIG. 1.
Figure 6B:
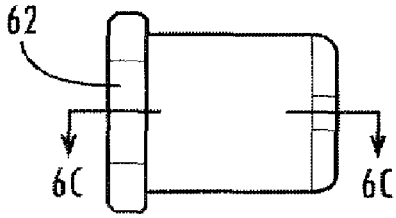
FIG. 6B illustrates a side view of the guide of FIG. 6A.
Figure 6C:
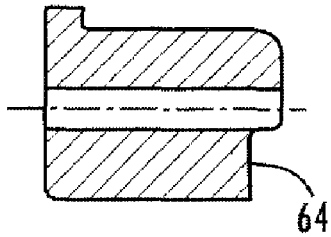
FIG. 6C illustrates a cross-section view taken along line 6C-6C of FIG. 6B.

Referring now to FIGS. 6A-C, the guide 60 is preferably keyed to the narrow portion of the penetration by having a larger diameter at one end which is chamfered or has a straight edge 62 so that the other end of the guide 60 does not obstruct the plunger 30 or seizure lock nut 34 when in opening 42. The end of the guide 60 closest to the plunger 30 and lock nut 34 may have a portion 64 removed if necessary depending on the proximity of the seizure assembly 10 in the opening 42. The guide 60 helps maintain the center conductor 18 in a straight condition, preventing the center conductor 18 from flexing and then possibly shorting against the housing 12 wall. The guide 60 surrounding the conductor 18 of stinger 20 allows the stinger 20 to have a better match between RF signals and surrounding ground because of the diameter and the dielectric constant of the material have been further optimized.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

What is claimed is:

1. An internal seizure assembly for providing connectivity to an external co-axial hard line cable comprising:

a seizure lock nut;

an elongated plunger for urging a conductor of a stinger into electrical contact with said seizure lock nut; and a seizure holder for receiving said plunger therethrough; wherein said seizure lock nut securing said seizure holder within a node housing.

2. The internal seizure assembly of claim 1 wherein said plunger has a first end keyed to a bottom of an opening into an interior surface of said housing to prevent said plunger from turning, and a second end urges the conductor of the stinger into electrical contact with said seizure lock nut.

3. The internal seizure assembly of claim 1 wherein access to said seizure assembly is not required from the exterior of the node housing in order to provide connectivity to an external cable via the conductor of the stinger.

4. An internal seizure assembly for providing connectivity to an external co-axial hard line cable comprising:

a seizure lock nut;

an elongated plunger for urging a conductor of a stinger into electrical contact with said seizure lock nut; and a seizure holder for receiving said plunger therethrough, wherein an end of said plunger includes a plurality of legs extending outward from said end with inclined portions in between adjacent said legs, wherein said legs and said inclined portions urge said conductor into electrical contact with said seizure lock nut; wherein said seizure lock nut securing said seizure holder within a node housing.

5. The seizure mechanism of claim 1 wherein said housing is free of physical access to said seizure assembly from the exterior of the node housing once installed in the node housing other than by opening the node housing itself.

6. The seizure assembly of claim 1 wherein said plunger, said seizure holder, and said seizure lock nut are assembled together entirely on the inside of said housing.

7. The seizure assembly of claim 1 wherein said seizure holder is threaded into the node housing from the interior of the node housing and retains said plunger in a partially compressed position.

8. An internal seizure assembly for providing connectivity to an external co-axial hard line cable comprising:

a seizure lock nut;

an elongated plunger for urging a conductor of a stinger into electrical contact with said seizure lock nut; and a seizure holder for receiving said plunger therethrough, wherein said plunger is oriented such that the conductor of the stinger necessarily passes between adjacent pairs of legs extending from an end of said plunger due to another end of said plunger being keyed to a bottom of an opening into an interior surface of the node housing to prevent said plunger from turning and to orient said legs of said plunger to receive the conductor therebetween;

wherein said seizure lock nut securing said seizure holder within a node housing.

9. The seizure assembly of claim 1 wherein in an opening for receiving said seizure assembly therein does not penetrate through the node housing in order to receive said seizure assembly, and said seizure holder adapted to be secured within said opening to retain said plunger.

10. The seizure assembly of claim 1 wherein said plunger is received by said seizure lock nut.

11. The seizure assembly of claim 1, wherein said seizure lock nut has at least one recess for receiving a portion of said plunger.

12. The seizure assembly of claim 11, wherein said plunger has a plurality of legs adapted to be received in said at least one recess.

13. The seizure assembly of claim 1, wherein said seizure holder has first and second open ends through which said plunger extends.

14. The seizure assembly of claim 1, wherein a bottom of said seizure holder contacts a keyed portion of said plunger to partially compress said plunger.

15. The seizure assembly of claim 1, wherein said assembly is installed in a node housing prior to the installation of a stinger, so that a stinger may be installed so that a stinger conductor compresses said plunger.

16. The seizure assembly of claim 1, wherein said assembly is installed in an opening into an interior surface of the node housing so that a spring of said plunger contacts the interior surface.

17. The internal seizure assembly of claim 4 wherein said plunger has a first end keyed to a bottom of an opening into an interior surface of said housing to prevent said plunger from turning, and a second end urges the conductor of the stinger into electrical contact with said seizure lock nut.

18. The internal seizure assembly of claim 4 wherein access to said seizure assembly is not required from the exterior of the node housing in order to provide connectivity to an external cable via the conductor of the stinger.

19. The seizure mechanism of claim 4 wherein said housing is free of physical access to said seizure assembly from the exterior of the node housing once installed in the node housing other than by opening the node housing itself.

20. The seizure assembly of claim 4 wherein said seizure holder is threaded into the node housing from the interior of the node housing and retains said plunger in a partially compressed position.

* * * * *